United States Patent [19]

Goodwin

[11] 4,046,348

[45] Sept. 6, 1977

[54] ADJUSTABLE HEIGHT STOOL

[76] Inventor: John E. Goodwin, 201 W. 157th St., Harvey, Ill. 60426

[21] Appl. No.: 738,036

[22] Filed: Nov. 2, 1976

[51] Int. Cl.[2] ..... A47C 3/40

[52] U.S. Cl. ..... 248/423; 248/188.5; 297/345; 108/144

[58] Field of Search ..... 297/345, 462; 248/188.5, 423, 408, 407; 108/144

[56] References Cited

U.S. PATENT DOCUMENTS

| | | | |
|---|---|---|---|
| 329,654 | 11/1885 | Kraemer | 248/423 |
| 859,233 | 7/1907 | Lane | 248/408 |
| 965,113 | 7/1910 | Konstantinides | 248/408 |
| 1,373,079 | 3/1921 | King | 297/345 |
| 2,396,022 | 3/1946 | Schmidt | 248/423 |

*Primary Examiner*—Francis K. Zugel
*Attorney, Agent, or Firm*—Allen D. Brufsky

[57] ABSTRACT

A stool having a base and a seat relatively adjustable to the base by a plurality of vertical cylindrical telescoping sections supporting the seat and fixed to the base. Radial retaining lugs fixed to telescoping rods housed within the cylindrical telescoping sections are received within slots in the sidewalls of the telescoping sections to lock the seat in adjusted position. The lugs are biassed by a coil spring between the rods into the slots. The spring is compressed to remove the lugs from the slots to readjust the height of the seat relative to the base.

7 Claims, 2 Drawing Figures

ADJUSTABLE HEIGHT STOOL

BACKGROUND OF THE INVENTION

This invention relates to an article of furniture, and more particularly, a portable, adjustable height stool.

The present invention provides a portable stool which is collapsible to a closed position for use as a step stool for reaching high places or for use as a hassock, but which can be extended to normal height for use as a bar stool or seat. Since the stool is portable, it is ideal for picnics, the viewing of sporting events, or other outdoor activities.

SUMMARY OF THE INVENTION

In accordance with the invention, the stool includes a base supporting a telescoping cylindrical seat support. Each telescoping section has a pair of slots on opposite diametrical portions of its side wall for receiving radial retaining lugs on a pair of telescoping tubular rods housed within the telescoping seat support. The lugs are normally biased into the slots by a spring to retain the seat support in extended position. By simultaneously depressing a pair of buttons connected to the telescoping rods against the bias of the spring, the lugs are removed sequentially from the slots enabling the seat support and rods to collapse, lowering a seat connected to the uppermost cylindrical section of the seat support to a desired adjusted level relative to the base.

BRIEF DESCRIPTION OF THE DRAWING

Further objects and advantages of the invention will become more apparent from the following description and claims, and from the accompanying drawing, wherein:

DETAILED DESCRIPTION OF THE PREFERRED EMBODIMENT

Figure 1:
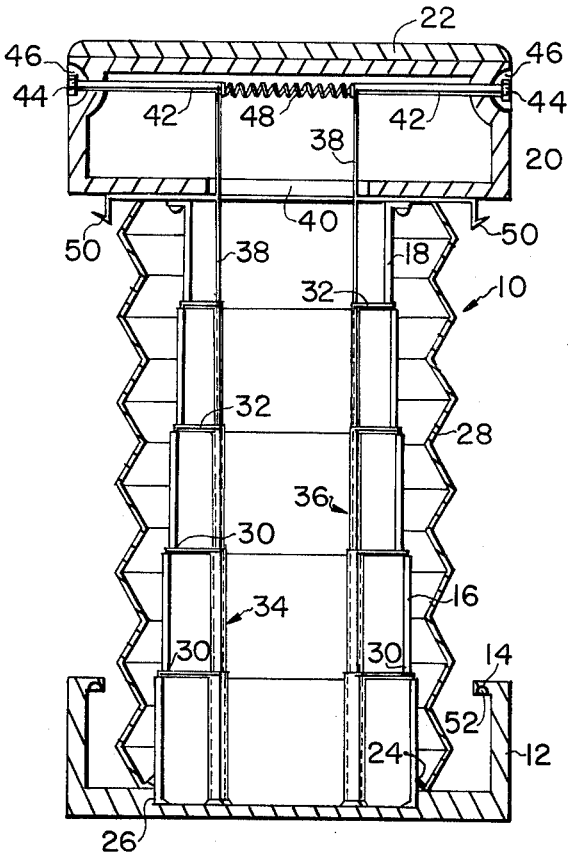
FIG. 1 is a longitudinal cross-sectional view of the stool of the present invention in extended position.

Referring now to the drawing in detail, wherein like numerals indicate like elements throughout the several views, the stool 10 of the present invention includes a hollow, substantially rectangular base 12 having an inwardly extending flange 14.

Base 12 supports a plurality of reduced diameter, telescoping cylindrical sections 16. The uppermost section 18 is connected by fasteners to the bottom of a rectangular hollow seat 20 having a rectangular leather, vinyl or cloth covering 22. The lowermost section 24 is fixed, by welding or the like, to a rectangular groove 26 in the interior of base 12. An accordian-type collapsible and extensible covering 28 surrounds telescoping sections 16 and is connected by suitable fasteners or adhesive to the bottom of seat 20 and the hollow interior of base 12.

Each telescoping section 16, except section 24, has a pair of slots 30 cut in the lower edge thereof along opposite diametrically opposed portions of their side wall for receiving radially extending retaining lugs 32 on a pair of parallel, upright telescoping tubular, flexible rods 34, 36 within the interior of telescoping cylindrical sections 16.

The lower end of each rod 34, 36 is fixed by welding or the like to the hollow interior of base 12, while the upper section 38 of each rod 34, 36 extends through an opening 40 in the bottom of seat 20 and is bent at a right angle to form a portion 42 terminating in a button 44 positioned in a depression 46 in the side of seat 20. The upper sections 38 of each rod 34, 36 are normally biassed apart by a compressed coil spring 48 extending between and having its ends connected to upper sections 38 of rods 34, 36. Biassing of sections 38 away from each other, causes radial lugs 32 on the top of each section of the telescoping rods 34, 36 to engage in slots 30 in the sidewalls of sections 16 to support the sections and seat 20 in extended position, as shown in FIG. 1, preventing their telescoping collapse.

However, by simultaneously depressing buttons 44 to move portions 42 of each rod 34, 36 towards each other against the bias of spring 48, the lugs 32 can be serially moved out of slots 30 from top to bottom as viewed in FIG. 1, enabling sections 16 to collapse serially, lowering seat 20 towards base 12, and storing each tubular section of the rods 34, 36 in telescoping relation.

The buttons 44 can be released at any intermediate height of stool 10 causing the lugs 32 at that height and at a lower level to reenter the remaining slots 30 to support seat 20 at that particular level. Because the length of lugs 32 are shorter from top to bottom, the collapsed lugs 32 do not interfere with the entry of the remaining lower lugs 32 into adjacent slots 30.

Figure 2:
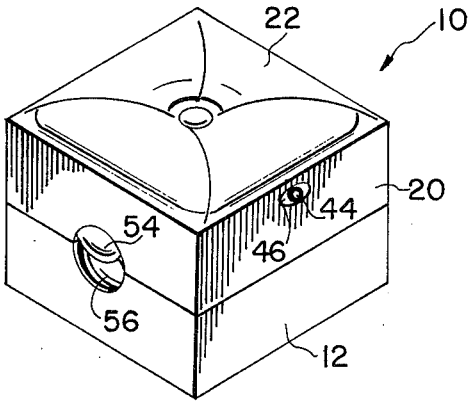
FIG. 2 is a perspective view of the stool of FIG. 1 in collapsed position.

In the completely collapsed position indicated in FIG. 2, the seat 20 can be locked to base 12 by a pair of resilient swivel hooks 50 adapted to seat beneath flange 14 and enter grooves 52 in the flange 14. The hooks 50 are fixed to portions 42 of each rod 34, 36 so that upon depression of buttons 44 against the bias of spring 48, seat 20 can be pulled away from base 12 until a desired height is reached, whereupon buttons 44 are released, enabling lugs 32 to enter slots 30.

Mating hand hold depressions 54, 56 on the side of seat 20 and base 12 can be used to carry stool 10 from location to location.

I claim:

1. A stool comprising:

a hollow base, a seat, vertical telescoping support means between the interior of said base and the bottom of said seat for adjustably moving said seat relative to said base, and means between said base and seat for retaining said telescoping support means in a plurality of adjusted vertical positions, said telescoping support means including a plurality of cylindrical telescoping sections, the lowermost of said sections being fixed to the interior of said base, the uppermost of said sections being fixed to the bottom of said seat, said retaining means including a pair of substantially parallel, vertical telescoping rods connected to said base and accessible through said seat housed within the interior of said cylindrical telescoping sections, means between said rods urging said rods away from each other, and a plurality of vertically spaced lugs on each of said rods received within diametrically opposed slots in the sidewall of said telescoping cylindrical sections.

2. The stool of claim 1 wherein the uppermost one of the telescoping sections of each of said tubular rods is bent at a 90° angle and terminates in a push button for moving said rods towards each other against the bias of said urging means to remove said lugs from the slots in the sidewall of said telescoping cylindrical sections.

3. The stool of claim 2 wherein said urging means includes a coil spring between said tubular rods.

4. The stool of claim 3 including an accordian-pleated sleeve connected between the bottom of said seat and said base in surrounding relation to said telescoping cylindrical sections.

5. The stool of claim 4 including clasp means for locking said and base together in collapsed position.

6. The stool of claim 5 wherein said seat and base are rectangular in plan.

7. The stool of claim 6 wherein said seat includes a cover member.

* * * * *